US012281523B2

(12) United States Patent
Cassidy et al.

(10) Patent No.: US 12,281,523 B2
(45) Date of Patent: Apr. 22, 2025

(54) DOWNHOLE CONNECTOR ORIENTATION FOR WETMATE CONNECTORS

(71) Applicant: Schlumberger Technology Corporation, Sugar Land, TX (US)

(72) Inventors: Christopher Cassidy, Pearland, TX (US); Julia Huynh, Houston, TX (US); Valeria Erives, Houston, TX (US); Yann Dufour, Houston, TX (US); Nabil Batita, Houston, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 0 days.

(21) Appl. No.: 18/548,945

(22) PCT Filed: Mar. 11, 2022

(86) PCT No.: PCT/US2022/019952
§ 371 (c)(1),
(2) Date: Sep. 5, 2023

(87) PCT Pub. No.: WO2022/192669
PCT Pub. Date: Sep. 15, 2022

(65) Prior Publication Data

US 2024/0151111 A1 May 9, 2024

Related U.S. Application Data

(60) Provisional application No. 63/160,134, filed on Mar. 12, 2021.

(51) Int. Cl.

| | |
|---|---|
| ***E21B 17/02*** | (2006.01) |
| ***E21B 17/046*** | (2006.01) |
| ***E21B 47/024*** | (2006.01) |

(52) U.S. Cl.
CPC ..... *E21B 17/028* (2013.01); *E21B 17/046* (2013.01); *E21B 47/024* (2013.01)

(58) Field of Classification Search
CPC .... E21B 17/028; E21B 47/022; E21B 47/024; E21B 17/046; E21B 43/10; E21B 47/12; E21B 17/02; E21B 47/125
See application file for complete search history.

(56) References Cited

U.S. PATENT DOCUMENTS

| | | | |
|---|---|---|---|
| 4,039,208 | A | 8/1977 | Pernet |
| 4,570,707 | A | 2/1986 | Setterberg, Jr. |

(Continued)

FOREIGN PATENT DOCUMENTS

| | | | |
|---|---|---|---|
| EP | 1212510 | A1 | 6/2002 |
| EP | 1251598 | A1 | 10/2002 |

(Continued)

OTHER PUBLICATIONS

International Search Report and Written Opinion of International Patent Application No. PCT/US2021/059923 dated Mar. 11, 2022, 11 pages.

(Continued)

*Primary Examiner* — Brad Harcourt
(74) *Attorney, Agent, or Firm* — Jeffrey D. Frantz

(57) ABSTRACT

Systems and methods are provided to facilitate connection of multiple stage completions. A first completion stage is deployed at a wellbore location. Subsequently, the next completion stage is moved downhole into engagement with the first completion stage. The completion stages each have communication lines that are coupled together downhole via a wetmate connection. Systems and methods for determining an orientation of the communication lines relative to the wellbore are also provided.

20 Claims, 15 Drawing Sheets

(56) References Cited

U.S. PATENT DOCUMENTS

| | | | |
|---|---|---|---|
| 4,682,848 | A | 7/1987 | Cairns |
| 5,066,060 | A | 11/1991 | Cooksey |
| 5,197,546 | A | 3/1993 | Murray |
| 5,577,925 | A | 11/1996 | Schnatzmeyer |
| 5,838,857 | A | 11/1998 | Niekrasz |
| 6,131,663 | A | 10/2000 | Henley |
| 6,152,608 | A | 11/2000 | Ghara |
| 6,186,229 | B1 | 2/2001 | Martin |
| 6,349,767 | B2 | 2/2002 | Gissler |
| 6,390,193 | B1 | 5/2002 | Martin |
| 6,510,899 | B1 | 1/2003 | Sheiretov et al. |
| 6,511,335 | B1 | 1/2003 | Rayssiguier |
| 6,568,481 | B2 | 5/2003 | Koehler |
| 6,571,046 | B1 | 5/2003 | Hickey |
| 6,668,921 | B2 | 12/2003 | Koehler |
| 6,776,636 | B1 | 8/2004 | Cameron |
| 6,929,404 | B2 | 8/2005 | Jones |
| 6,983,796 | B2 | 1/2006 | Bayne |
| 7,165,892 | B2 | 1/2007 | Grigsby |
| 7,191,832 | B2 | 3/2007 | Grigsby |
| 7,228,898 | B2 | 6/2007 | Grigsby |
| 7,252,437 | B2 | 8/2007 | Ringgenberg |
| 7,398,822 | B2 | 7/2008 | Meijer |
| 7,475,734 | B2 | 1/2009 | O'Malley |
| 7,487,830 | B2 | 2/2009 | Wolters |
| 7,503,395 | B2 | 3/2009 | Meijer et al. |
| 7,509,000 | B2 | 3/2009 | Coronado |
| 7,510,003 | B2 | 3/2009 | Meijer |
| 7,556,093 | B2 | 7/2009 | Grigsby |
| 7,594,763 | B2 | 9/2009 | Richards |
| 7,607,477 | B2 | 10/2009 | Stoesz |
| 7,611,290 | B2 | 11/2009 | Ringgenberg |
| 7,628,543 | B2 | 12/2009 | Coronado |
| 7,640,977 | B2 | 1/2010 | Jonas |
| 7,644,755 | B2 | 1/2010 | Stoesz |
| 7,736,067 | B2 | 6/2010 | Read |
| 7,798,212 | B2 | 9/2010 | Bolze et al. |
| 7,806,190 | B2 | 10/2010 | Du |
| 7,900,698 | B2 | 3/2011 | Stoesz |
| 8,061,429 | B2 | 11/2011 | Du |
| 8,061,430 | B2 | 11/2011 | Du |
| 8,082,990 | B2 | 12/2011 | Lovell |
| 8,113,290 | B2 | 2/2012 | Sharma |
| 8,496,064 | B2 | 7/2013 | Du |
| 8,550,175 | B2 | 10/2013 | Shafiq |
| 8,596,348 | B2 | 12/2013 | Brookbank |
| 8,752,635 | B2 | 6/2014 | Wang |
| 8,794,337 | B2 | 8/2014 | Thomas |
| 8,839,850 | B2 | 9/2014 | Algeroy |
| 8,936,078 | B2 | 1/2015 | Richards |
| 9,157,561 | B2 | 10/2015 | Martin |
| 9,270,051 | B1 | 2/2016 | Christiansen |
| 9,404,314 | B2 | 8/2016 | Perez |
| 9,500,071 | B2 * | 11/2016 | Morgan-Smith ..... E21B 47/12 |
| 9,523,243 | B2 | 12/2016 | Richards |
| 9,627,798 | B2 | 4/2017 | Plant |
| 9,683,412 | B2 | 6/2017 | Richards |
| 9,759,016 | B2 | 9/2017 | Perez |
| 9,850,720 | B2 | 12/2017 | Richards |
| 9,915,104 | B2 | 3/2018 | Richards |
| 9,945,203 | B2 | 4/2018 | Patel |
| 9,988,894 | B1 | 6/2018 | Malone |
| 10,000,995 | B2 | 6/2018 | Bishop |
| 10,060,196 | B2 | 8/2018 | Richards |
| 10,113,371 | B2 | 10/2018 | Richards |
| 10,267,097 | B2 | 4/2019 | Mendez |
| 10,329,855 | B2 | 6/2019 | Brady |
| 10,329,871 | B2 | 6/2019 | King |
| 10,352,110 | B2 | 7/2019 | Olin |
| 10,502,003 | B2 | 12/2019 | Johnson |
| 10,619,424 | B2 | 4/2020 | Loh |
| 10,934,785 | B2 | 3/2021 | Fripp |
| 11,162,306 | B2 | 11/2021 | Simonsen |
| 11,193,339 | B2 | 12/2021 | El Mallawany |
| 11,646,526 | B2 | 5/2023 | Burrow |
| 2003/0211768 | A1 | 11/2003 | Cameron |
| 2005/0072564 | A1 | 4/2005 | Grigsby |
| 2006/0086508 | A1 | 4/2006 | Coon |
| 2006/0243450 | A1 | 11/2006 | Head |
| 2006/0243454 | A1 | 11/2006 | Bolze et al. |
| 2006/0260803 | A1 | 11/2006 | Meijer et al. |
| 2008/0029274 | A1 | 2/2008 | Rytlewski |
| 2008/0223585 | A1 | 9/2008 | Patel |
| 2009/0045146 | A1 | 2/2009 | Stoesz |
| 2009/0321069 | A1 | 12/2009 | Jonas |
| 2010/0314109 | A1 | 12/2010 | Garcia et al. |
| 2011/0192596 | A1 | 8/2011 | Patel |
| 2012/0168178 | A1 | 7/2012 | Eriksen |
| 2013/0048307 | A1 | 2/2013 | Patel |
| 2013/0153203 | A1 | 6/2013 | Lauderdale |
| 2013/0153207 | A1 | 6/2013 | Lauderdale |
| 2013/0306316 | A1 | 11/2013 | Patel |
| 2013/0319685 | A1 | 12/2013 | Pike |
| 2013/0327546 | A1 | 12/2013 | Rytlewski |
| 2014/0352793 | A1 | 12/2014 | Martin et al. |
| 2015/0368983 | A1 | 12/2015 | Perez et al. |
| 2015/0376956 | A1 * | 12/2015 | Richards ..... E21B 47/135 166/242.6 |
| 2016/0006161 | A1 | 1/2016 | Ranalli |
| 2016/0273290 | A1 | 9/2016 | Harms |
| 2016/0356095 | A1 | 12/2016 | Perez |
| 2017/0044843 | A1 | 2/2017 | Hanton |
| 2017/0357051 | A1 | 12/2017 | Bulu |
| 2019/0153788 | A1 | 5/2019 | El Mallawany |
| 2020/0080398 | A1 | 3/2020 | Loh |
| 2021/0032940 | A1 | 2/2021 | Simonsen |
| 2022/0081993 | A1 | 3/2022 | Chevallier |
| 2022/0081994 | A1 | 3/2022 | Chevallier |

FOREIGN PATENT DOCUMENTS

| | | | |
|---|---|---|---|
| GC | 2881 | A | 9/2014 |
| WO | 2004079151 | A2 | 9/2004 |
| WO | 2014089132 | A1 | 6/2014 |
| WO | 2015060817 | A1 | 4/2015 |
| WO | 2015044208 | A3 | 6/2015 |
| WO | 2017105434 | A1 | 6/2017 |
| WO | 2017213726 | A2 | 12/2017 |
| WO | 2020087001 | A1 | 4/2020 |
| WO | 2021247726 | A1 | 12/2021 |
| WO | 2022109157 | A1 | 5/2022 |
| WO | 2022216933 | A1 | 10/2022 |

OTHER PUBLICATIONS

"Control Line Wet Mate (CLWM) Connector", product sheet downloaded from [https://www.slb.com/-/media/files/co/product-sheet/control-line-wet-mate-ps.ashx] on Jun. 29, 2022, 2 pages.

"HLWM Hydraulic-line downhole wet-mate connector", product sheet downloaded from [https://www.slb.com/-/media/files/co/product-sheet/hlwm-ps.ashx] downloaded on Jun. 29, 2022, 2 pages.

"HEWM Hydraulic and electric downhole wet-mate connector" product sheet downloaded from [https://www.slb.com/-/media/files/co/product-sheet/hewm-ps.ashx] downloaded on Jun. 29, 2022, 2 pages.

B.K. Drakeley et. al, 2014, "Integration into the Sandface Tool System for Gravel and Frack-Pack Installations with a Fiber Optics Wet-Mate Connector System", OTC-25195-MS, Offshore Technology Conference, held in Houston, Texas, USA, May 5-8, 2014 (15 pages).

International Search Report and Written Opinion of International Patent Application No. PCT/US2022/019952 dated Jun. 20, 2022, 10 pages.

International Search Report and Written Opinion of International Patent Application No. PCT/US2022/023838 dated Jul. 26, 2022, 12 pages.

"SureCONNECT Downhole Intelligent Wet-Mate System", downloaded on May 21, 2023 from link https://www.bakerhughes.com/completions/well-monitoring-and-analytics/sureconnect-downhole-intelligent-wetmate-system (8 pages).

(56) References Cited

OTHER PUBLICATIONS

"QUANTUM Snap Latch Assembly", (2014) SLB product sheet, downloaded on May 21, 2023, from link https://www.bing.com/searchq=QUANTUM+Snap+Latch+Assembly search= pc=U522 form=CHRDEF, (1 page).
"QUANTUM Anchor Latch Assembly", (2014) SLB product sheet, downloaded on May 21, 2023 from link https://www.bing.com/searchq=QUANTUM+Anchor+Latch+Assembly qs=n form=QBRE sp=-1 ghc=1 lq=0 pq=quantum+anchor+latch+assembly sc=6-29 sk= cvid=C6BC1C74AC8C44EC9D227795D68F1DD9 ghsh=0 ghacc=0 ghpl= (1 page).
"QUANTUM Shear-Type Anchor Latch" (2014), SLB product sheet, downloaded on May 21, 2023, from link https://www.bing.com/searchq=QUANTUM+Shear-Type+Anchor+Latch qs=n form=QBRE sp=-1 ghc=1 lq=0 pq=quantum+shear-type+anchor+latch sc=6-31 sk= cvid=A2F41C06C6DB44198EEFF506C1CB5DFB ghsh=0 ghacc=0 ghpl= (1 page).
International Search Report and Written Opinion issued in the PCT Application PCT/US2021/035478, dated Nov. 12, 2021 (12 pages).
Office Action issued in U.S. Appl. No. 18/553,902 issued Nov. 6, 2024, 7 pages.

* cited by examiner

DOWNHOLE CONNECTOR ORIENTATION FOR WETMATE CONNECTORS

CROSS-REFERENCE TO RELATED APPLICATIONS

Any and all applications for which a foreign or domestic priority claim is identified in the Application Data Sheet as filed with the present application are hereby incorporated by reference under 37 CFR 1.57. The present application is a National Stage Entry of International Application No. PCT/US2022/019952, filed Mar. 11, 2022, which claims priority benefit of U.S. Provisional Application No. 63/160,134, filed Mar. 12, 2021, the entirety of which is incorporated by reference herein and should be considered part of this specification.

BACKGROUND

Field

The present disclosure generally relates to multi-stage completions and downhole connectors for use in oil and gas wells, and more particularly, to systems and methods for connecting multi-stage completions, for example, including, but not limited to, multi-stage completions including optical fibers.

Description of the Related Art

Many types of wells, e.g., oil and gas wells, are completed in multiple stages. For example, a lower stage of the completion, or lower completion assembly, is moved downhole on a running string. After deployment of the lower completion assembly at a desired location in the wellbore, an upper stage of the completion, or upper completion assembly, is deployed downhole and engaged with the lower completion assembly.

In many applications, it is desirable to instrument the lower completion with electrical or optical sensors or to provide for transmission of fluids to devices in the lower completion. For example, a fiber optic cable can be placed in the annulus between the screen and the open or cased hole. To enable communication of signals between the sensor in the lower completion and the surface or seabed, a wet-mate connection is needed between the upper and lower completion equipment.

SUMMARY

In some configurations, a downhole completion system includes an upper completion stage comprising at least one first communication line connector; a lower completion stage comprising at least one second communication line connector, the first communication line connector configured to couple to the second communication line connector; and an orientation device configured to help determine and/or control orientation of the second communication line connector relative to a well during or prior to installation.

The lower completion stage can include two second communication line connectors. The orientation device can be configured to help center the second communication line connectors about the top of the well. The orientation device can be configured to help position the second communication line connector(s) at or centered about a top of a deviated or horizontal well during installation. In some configurations, the upper completion stage includes a stinger, the lower completion stage includes a receptacle, and the stinger is configured to engage the receptacle. The stinger can include the at least one first communication line connector, the receptacle can include the at least one second communication line connector, and engagement of the stinger with the receptacle can engage the first communication line connector with the second communication line connector.

The orientation device can include accelerometers and/or gyrometers configured to provide data to determine orientation of the second communication line connector. The orientation device can further include a telemetry module configured to transmit data from the accelerometers and/or gyrometers to the surface to determine orientation of the second communication line connector. The downhole completion system can include a service string comprising the orientation device, the service string coupled to the lower completion stage for deployment of the lower completion stage in a well.

The orientation device can include an index casing coupling incorporated into a casing string deployed in a well, the index casing coupling comprising an orientation feature. The downhole completion system can further include a service tool including an orientation measurement tool and an orientation key. The orientation measurement tool is configured to provide data to determine the orientation of the index casing coupling when the service tool is run in hole in the casing string and the orientation key of the service tool is engaged with the orientation feature of the index casing coupling.

In some configurations, a method of forming a completion in a wellbore includes deploying a lower completion stage in a wellbore, the lower completion stage comprising at least one first communication line connector; determining an orientation of the at least one first communication line connector with respect to the wellbore; deploying an upper completion stage in the wellbore, the upper completion stage comprising at least one second communication line connector; and coupling the first and second communication line connectors.

Determining an orientation of the at least one first communication line connector can include transmitting data from an orientation device located on or connected to the lower completion to the surface via an electrical cable or wireless telemetry. In some configurations, the method further includes rotating the lower completion if needed to orient the at least one first communication line connector in a desired orientation or position. The wellbore can be a deviated or horizontal wellbore. In such configurations, the desired orientation or position can be at, near, or centered on or about a top of the wellbore.

In some configurations, a method of forming a completion in a wellbore includes: incorporating a casing orientation device into a casing string; deploying the casing string in a wellbore; running a service tool in hole within the casing string; measuring an orientation of the casing orientation device using an orientation measurement tool of the service tool; deploying a lower completion stage in the wellbore such that one or more first communication line connectors of the lower completion stage are positioned in a desired orientation based on the orientation of the casing orientation device measured by the service tool; deploying an upper completion stage in the wellbore, the upper completion stage comprising at least one second communication line connector; and coupling the first and second communication line connectors.

The casing orientation device can include an orientation feature, the service tool can include a corresponding orientation features, and running the service tool in hole can include engaging the orientation feature of the service tool with the orientation feature of the casing orientation device. Measuring an orientation of the casing orientation device can include determining an orientation of the orientation feature relative to a desired orientation of the one or more first communication line connectors when deployed in the wellbore. The method can further include, prior to deploying the lower completion stage in the wellbore, coupling an orientation landing tool comprising an orientation feature to the lower completion stage, and orienting the orientation landing tool and lower completion stage relative to each other such that when the orientation feature of the orientation landing tool is positioned at the orientation of the orientation feature of the casing orientation device as measured by the service tool, the one or more first communication line connectors are positioned at the desired orientation. The wellbore can be a deviated or horizontal wellbore and the desired orientation or position can be at, near, or centered on or about a top of the wellbore.

BRIEF DESCRIPTION OF THE FIGURES

Certain embodiments, features, aspects, and advantages of the disclosure will hereafter be described with reference to the accompanying drawings, wherein like reference numerals denote like elements. It should be understood that the accompanying figures illustrate the various implementations described herein and are not meant to limit the scope of various technologies described herein.

DETAILED DESCRIPTION

Figure 1:
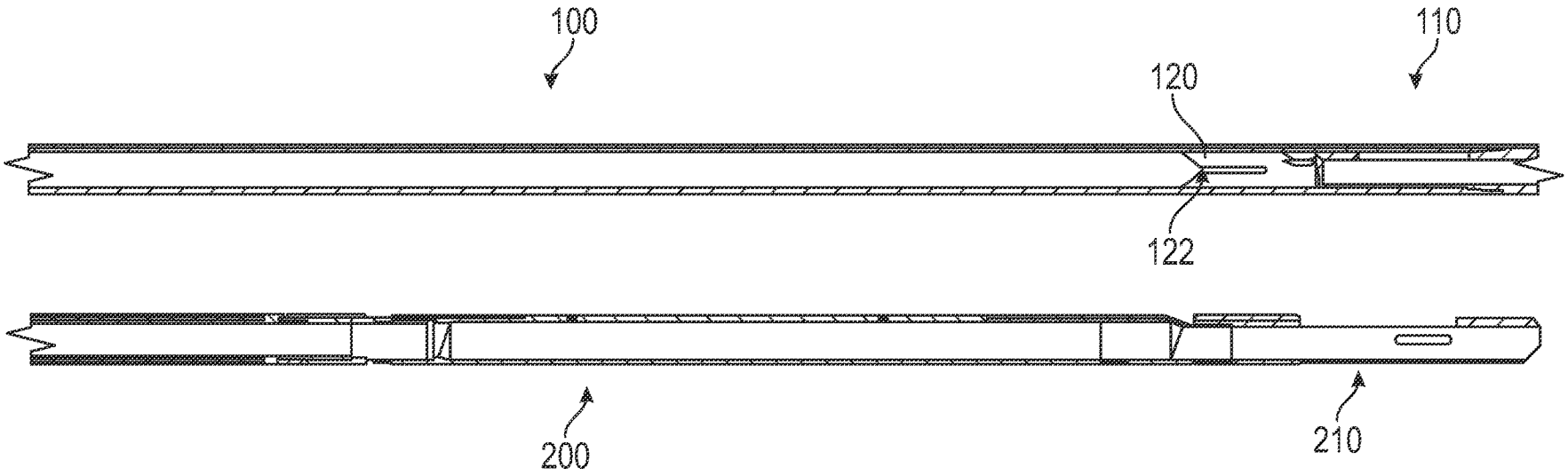
FIG. 1 illustrates an example two-stage completion.

In the following description, numerous details are set forth to provide an understanding of some embodiments of the present disclosure. It is to be understood that the following disclosure provides many different embodiments, or examples, for implementing different features of various embodiments. Specific examples of components and arrangements are described below to simplify the disclosure. These are, of course, merely examples and are not intended to be limiting. However, it will be understood by those of ordinary skill in the art that the system and/or methodology may be practiced without these details and that numerous variations or modifications from the described embodiments are possible. This description is not to be taken in a limiting sense, but rather made merely for the purpose of describing general principles of the implementations. The scope of the described implementations should be ascertained with reference to the issued claims.

As used herein, the terms "connect", "connection", "connected", "in connection with", and "connecting" are used to mean "in direct connection with" or "in connection with via one or more elements"; and the term "set" is used to mean "one element" or "more than one element". Further, the terms "couple", "coupling", "coupled", "coupled together", and "coupled with" are used to mean "directly coupled together" or "coupled together via one or more elements". As used herein, the terms "up" and "down"; "upper" and "lower"; "top" and "bottom"; and other like terms indicating relative positions to a given point or element are utilized to more clearly describe some elements. Commonly, these terms relate to a reference point at the surface from which drilling operations are initiated as being the top point and the total depth being the lowest point, wherein the well (e.g., wellbore, borehole) is vertical, horizontal or slanted relative to the surface.

Many types of wells, e.g., oil and gas wells, are completed in multiple stages. For example, a lower stage of the completion, or lower completion assembly, is moved downhole on a running string. After deployment of the lower completion assembly at a desired location in the wellbore, an upper stage of the completion, or upper completion assembly, is deployed downhole and engaged with the lower completion assembly.

Many well completions incorporate one or more control lines, such as optical, electrical, and/or hydraulic control lines, to carry signals to or from components of the downhole completion. For example, in many applications, it is desirable to instrument the lower completion with hydraulic, electrical, or optical sensors or to provide for transmission of fluids to devices in the lower completion. To enable communication of signals between the sensor(s) in the lower completion and the surface or seabed, a wet-mate connection is needed between the upper and lower completion equipment. The completion of wells in two or more stages, however, can create difficulties in forming dependable and repeatable control line connections between adjacent completion assemblies.

The present disclosure provides systems and methods for connecting and providing communication between an upper completion and a lower completion. In some configurations, the present disclosure provides various systems and methods for debris prevention, mitigation, and/or management. As used herein, "lower" can refer to a first or lead equipment/assembly moved downhole. "Upper" can refer to a second or later equipment/assembly moved downhole into engagement with the lower unit. In a horizontal wellbore, for example, the lower equipment/assembly is run downhole first prior to the upper equipment/assembly.

Such systems and methods allow for various types of connections and/or communication between the upper and lower completion, for example, control line communication and/or connection, fiber optic communication and/or connection, electrical connection and/or communication, etc. For example, some fiber optic electric wet mate systems and methods according to the present disclosure advantageously establish a fiber optic connection and electrical connection, and allow for fiber optic and electrical signal communication.

Systems and methods according to the present disclosure can advantageously allow for monitoring, e.g. continuous real time monitoring, or temperature (or other data) along the entire length of the upper and lower completion, for example, using an optical fiber deployed or housed within a control line. Additionally or alternatively, systems and methods according to the present disclosure can advantageously allow for water injection and/or hydraulic communication to or with the lower completion. In some configurations, systems and methods according to the present disclosure advantageously allow for transmission of signals, e.g., electrical and/or hydraulic signals, to actuate various devices along the lower completion string, such as flow control devices and/or isolation valves. Additionally or alternatively, such signals, e.g., electrical and/or hydraulic signals, can be used to actuate setting sequence(s) for packer(s).

In some configurations, systems and methods according to the present disclosure allow for deploying and connecting a fiber optic sensor network in a two-stage completion. In some configurations, the lower completion can be run with fiber, then the upper completion can be run with fiber, and the fiber of the upper completion and fiber of the lower completion can be mated via a connector. This can advantageously save time during deployment and installation as the fiber does not need to be pumped from the surface once a wetmate connection has been established. Such a configuration can also allow for use in wells in which fiber cannot be pumped, for example, in wells with subsea trees. Once the connection is established, a continuous optical path is established from a surface location to the bottom of an open hole formation. In some configurations, systems and methods according to the present disclosure also allow for connecting other types of control lines and/or connectors, such as electrical control lines or connectors or fluid control lines or connectors. Different types of control lines and/or connectors, including fiber optic, electrical, and/or hydraulic control lines and/or connections, can be included in various combinations. The connections may be established, broken, and reestablished repeatedly.

Connection systems and methods according to the present disclosure may be used for land applications, offshore platform applications, or subsea deployments in a variety of environments and with a variety of downhole components. The systems and methods can be used to connect a variety of downhole control lines, including communication lines, power lines, electrical lines, fiber optic lines, hydraulic conduits, fluid communication lines, and other control lines. The connections can allow for the deployment of sensors, e.g., fiber optic sensors, in sand control components, perforating components, formation fracturing components, flow control components, or other components used in various well operations including well drilling operations, completion operations, maintenance operations, and/or production operations.

The upper and lower completion assemblies can include a variety of components and assemblies for multistage well operations, including completion assemblies, drilling assemblies, well testing assemblies, well intervention assemblies, production assemblies, and other assemblies used in various well operations. The upper and lower assemblies can include a variety of components depending on the application, including tubing, casing 10, liner hangers, formation isolation valves, safety valves, other well flow/control valves, perforating and other formation fracturing tools, well sealing elements, e.g., packers, polish bore receptacles, sand control components, e.g., sand screens and gravel packing tools, artificial lift mechanisms, e.g., electric submersible pumps or other pumps/gas lift valves and related accessories, drilling tools, bottom hole assemblies, diverter tools, running tools and other downhole components.

FIG. 1 illustrates an example two-stage completion including an upper completion 200 and a lower completion 100. The upper completion 200 can include a stinger 210. In the illustrated configuration, the stinger 210 is positioned at a bottom end of the upper completion 200. The lower completion 100 can include a receptacle 110. In the illustrated configuration, the receptacle 110 is positioned at the bottom of the lower completion 100. In use, the upper completion 200 is run inside the lower completion 100, and the stinger 210 engages the receptacle 110 to complete a downhole connection.

Figure 2:
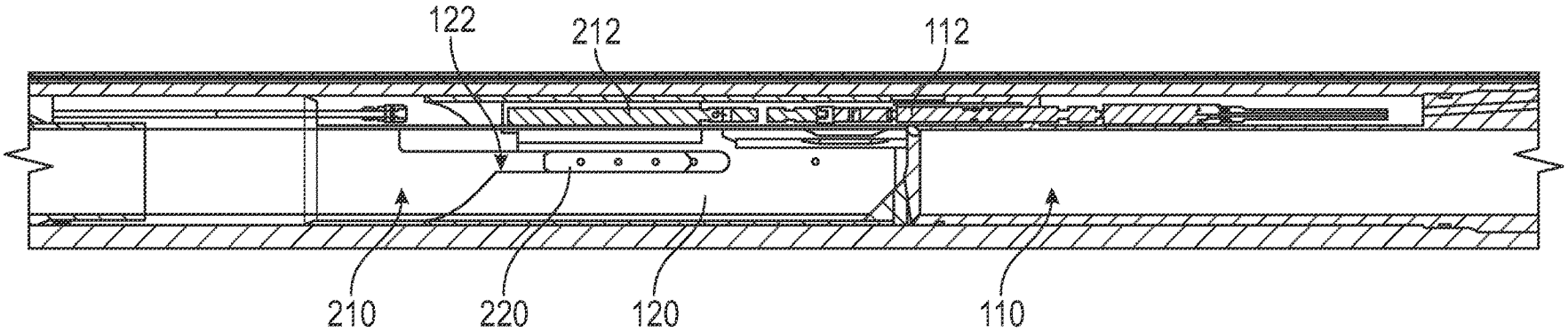
FIG. 2 illustrates an example downhole wetmate system.
Figure 3:
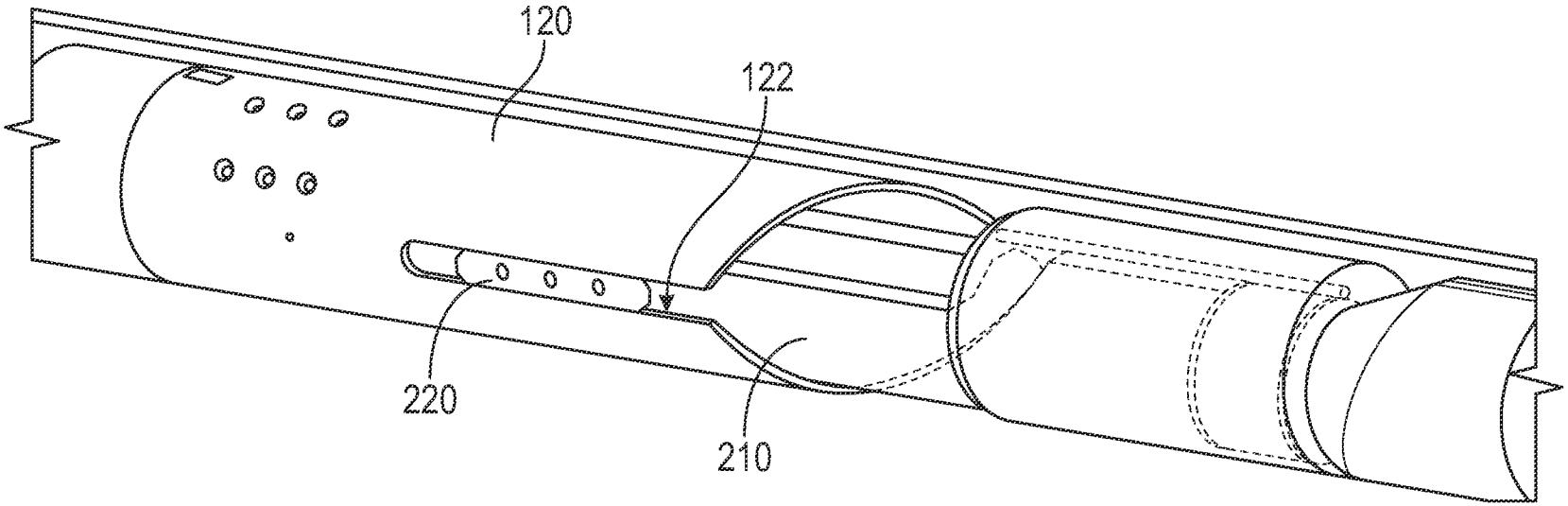
FIG. 3 illustrates engagement of a stinger and receptacle of the downhole wetmate system of FIG. 2.

FIG. 2 shows an example downhole wetmate system, for example that can be included in a two-stage completion such as that shown in FIG. 1. The upper completion 200, for example, the stinger 210, can include one or more upper connectors 212. The lower completion 100, for example, the receptacle 110, can include one or more lower connectors 112. The upper and lower connectors can be of various types and allow for connections of various types, including fiber optic, electric, and/or hydraulic connectors and connections. In use, as the upper completion 200 is run in hole, the stinger 210 is lowered until a stinger key 220 on the stinger contacts or engages an alignment sleeve 120 of the receptacle 110. The alignment sleeve 120 has a generally helical or curved profile. The stinger key 220 rotates along the helix of the alignment sleeve 120 until the stinger key 220 is clocked or aligned with a slot 122 in the alignment sleeve 120. The upper completion is then further lowered as the stinger key 220 moves into and along the slot 122 until the stringer fully engages the receptacle, as shown in FIG. 3. The upper connectors 212 are then mated with the lower connectors 112, as shown in FIG. 2.

Figure 7B:
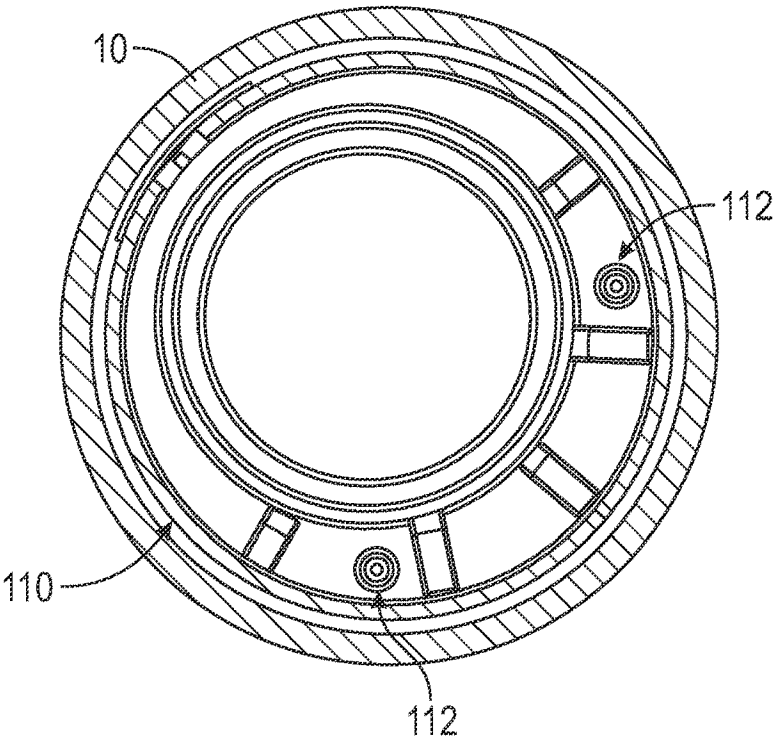
FIG. 7B illustrates a transverse cross-sectional view of the lower completion, showing the lower connectors in a high-risk orientation.
Figure 7A:
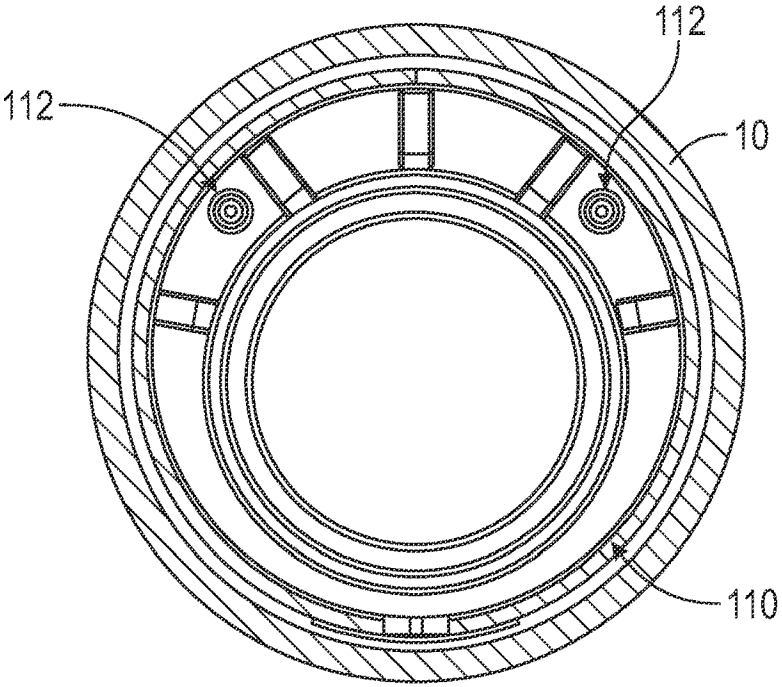
FIG. 7A illustrates a transverse cross-sectional view of the lower completion, showing the lower connectors in a correct orientation.

Establishing a connection between the upper connectors 212 and lower connectors 112 downhole is often challenging due to debris particles, which can inhibit proper mating of the connectors and/or can damage the connector(s). In deviated or horizontal wells, debris can be problematic particularly based on the location of the connectors relative to the bottom of the tubing, where the debris is likely to accumulate due to gravity. The present disclosure provides systems and methods for determining and controlling the orientation of the connectors downhole to advantageously reduce the likelihood of debris particles compromising the mating of the connectors. The ability to determine the orientation of the connector(s) allows the completion string to be rotated so that the connector(s) are oriented and/or positioned in a desired orientation and/or position. For example, the connector(s) may be oriented and centered on or about the top of the hole, for example as shown in FIG. 7A, to advantageously reduce debris accumulation from settling particles.

Figure 4:
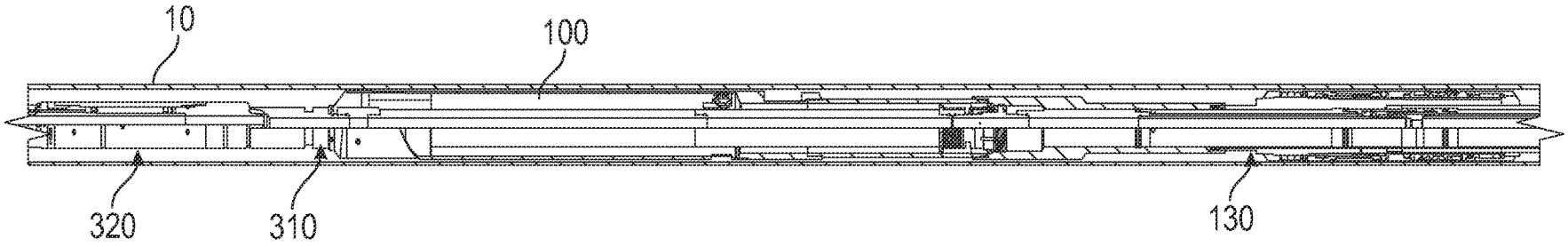
FIG. 4 illustrates an example lower completion and running assembly.

FIG. 4 illustrates an example lower completion of a multi-string or multi-stage system along with a running assembly 300 used to install the lower completion, for example, in a deviated or horizontal well. The running assembly 300 can include, for example, running tool(s), setting tool(s), and/or service tool(s). Various components located downhole may receive signals (e.g., fiber optic, electric, hydraulic) from and/or transmit signals to the surface, for example, for operation and/or monitoring well conditions. Connectors, such as shown in and described with respect to FIGS. 1-3, enable signal transmission between the lower completion and other completions in the multi-string system.

In deviated wells, the connectors 112, 212 could become oriented to sit at or near the bottom of the hole, where debris would likely settle around the connector(s) and potentially prevent signal transmission. To avoid such an orientation and debris accumulation, an orientation device allows for determination of the location or orientation of the connector(s) relative to the hole. The connector(s) can then be installed at and centered on the top of the well, for example as shown in FIG. 7A.

Figure 5:
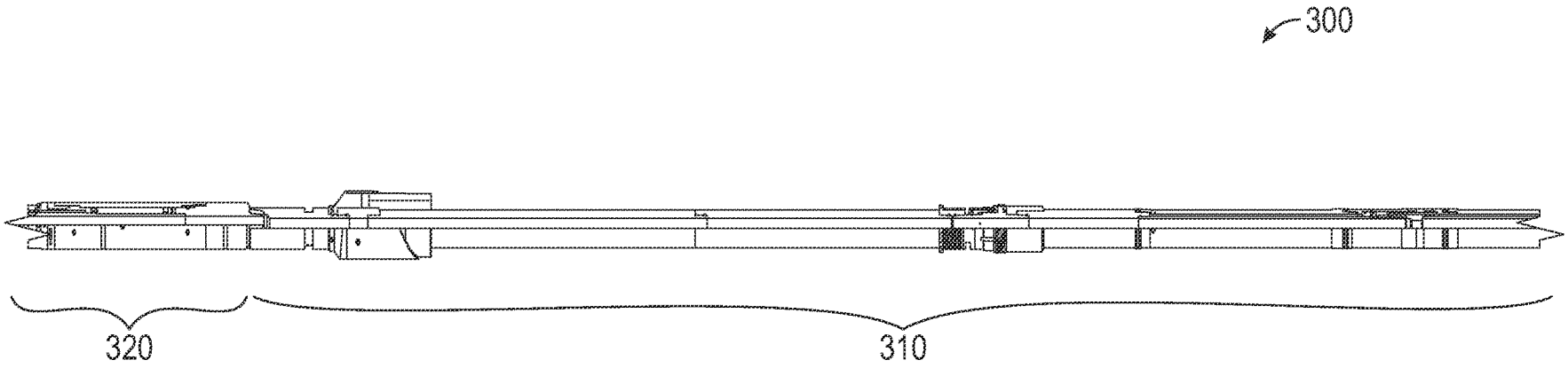
FIG. 5 illustrates an example running assembly.

FIG. 5 illustrates an example running assembly 300. In some configurations, the orientation device 320 is disposed on or in, or included as part of, the running assembly 300, running tool 310, or setting tool. As the running assembly 300 or tool 310 is re-usable, including the orientation device 320 on or in the running tool assembly 300 or tool 310 allows the orientation device 320 to also be re-usable. The running assembly 300 can include an electrical cable to provide power to the orientation device 320 and/or to transmit data to/from the orientation device 320 and the surface. Alternatively, for example if an electrical cable cannot be integrated into the running assembly 300, the orientation device 320 can be powered by batteries, and/or data transmission to/from the orientation device 320 and the surface can be provided through for example, wireless modems, acoustically through tubing vibrations, or through pressure pulses downhole.

Figure 6:
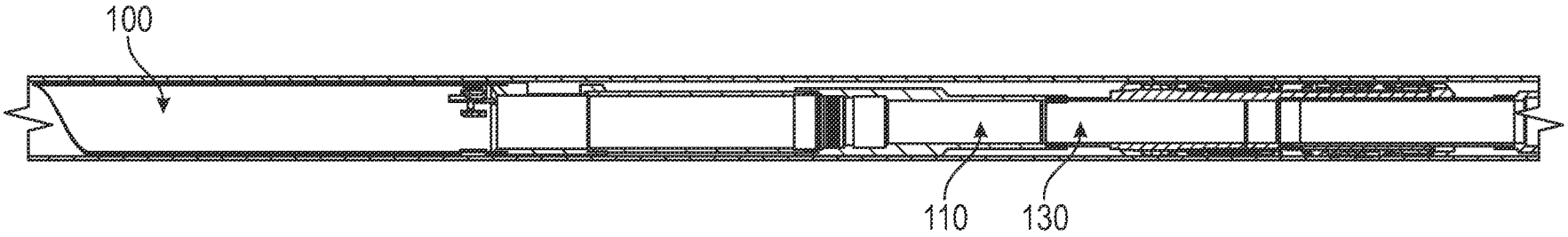
FIG. 6 illustrates an example lower completion and anchor device.

FIG. 6 illustrates an example lower completion 100. The lower completion 100 includes the wetmate receptacle 110 as shown and described herein. The lower wetmate connector(s) 112 can be exposed to the well environment, or sheltered by a debris exclusion device. An anchoring device 130, for example, a packer or liner hanger, can be disposed proximate, adjacent, or connected to the lower completion 100. In the illustrated configuration, the anchoring device 130 is downhole of the lower completion 100. In use, the anchoring device 130 secures the lower completion 100 in the well when activated by the running tool 310. In some configurations, the orientation device 320 and/or data transmission device(s) can be disposed in or on, or included as part of, the lower completion 100 rather than the running tool assembly 300, running tool 310, or setting tool.

Figure 8:
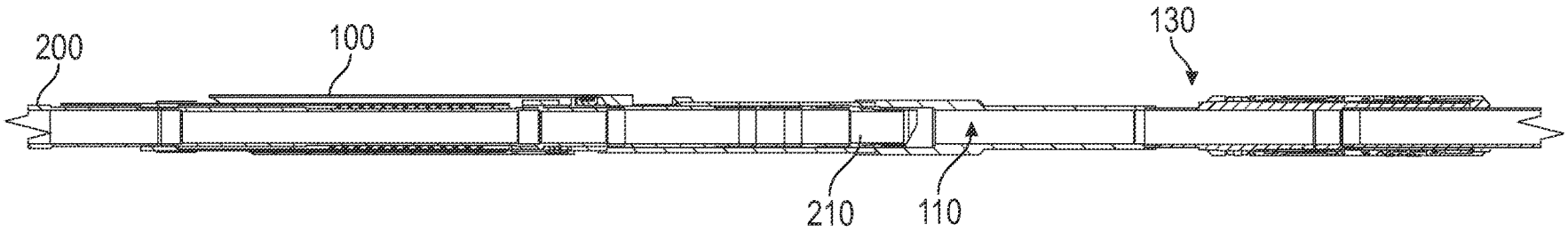
FIG. 8 illustrates the upper completion engaged with the lower completion.

During deployment, once the running assembly 300 and lower completion 100 have reached the desired depth, the orientation of the connector(s) 112 is read. In other words, data indicating the orientation of the connector(s) 112 is transmitted to the surface. As the running assembly 300 is coupled to the lower completion 100 in a known relative orientation, the orientation device 320 of the running assembly 300 can provide information regarding the orientation of the connector(s) of the lower completion 100. If the connector(s) 112 are in a risky or less desired orientation or position, for example as shown in FIG. 7B, the lower completion 100 can be rotated from the surface to reorient the connector(s) 112 to the appropriate or desired position or orientation, for example as shown in FIG. 7A. When the connector(s) 112 are determined to be in the desired orientation, the anchoring device 130 is activated to secure their location downhole. The upper completion 200 can then be run in hole until the stinger 210 and/or upper connectors 212 mate with the receptacle 110 and/or lower connectors 112, as shown in FIG. 8. In some configurations, the upper completion 200 can be run in hole with the lower completion 100. The upper completion 200 can then be separated from the lower completion 100 later during the life of the well. In such configurations, the orienting device 320 can ensure the connectors 112 are oriented and/or positioned in a desired orientation and/or position, for example, at, about, and/or centered on or about the top of the well or casing 10, which can advantageously aid with easier de-mating and later re-mating of the upper completion 200 with the lower completion 100.

Figure 9:
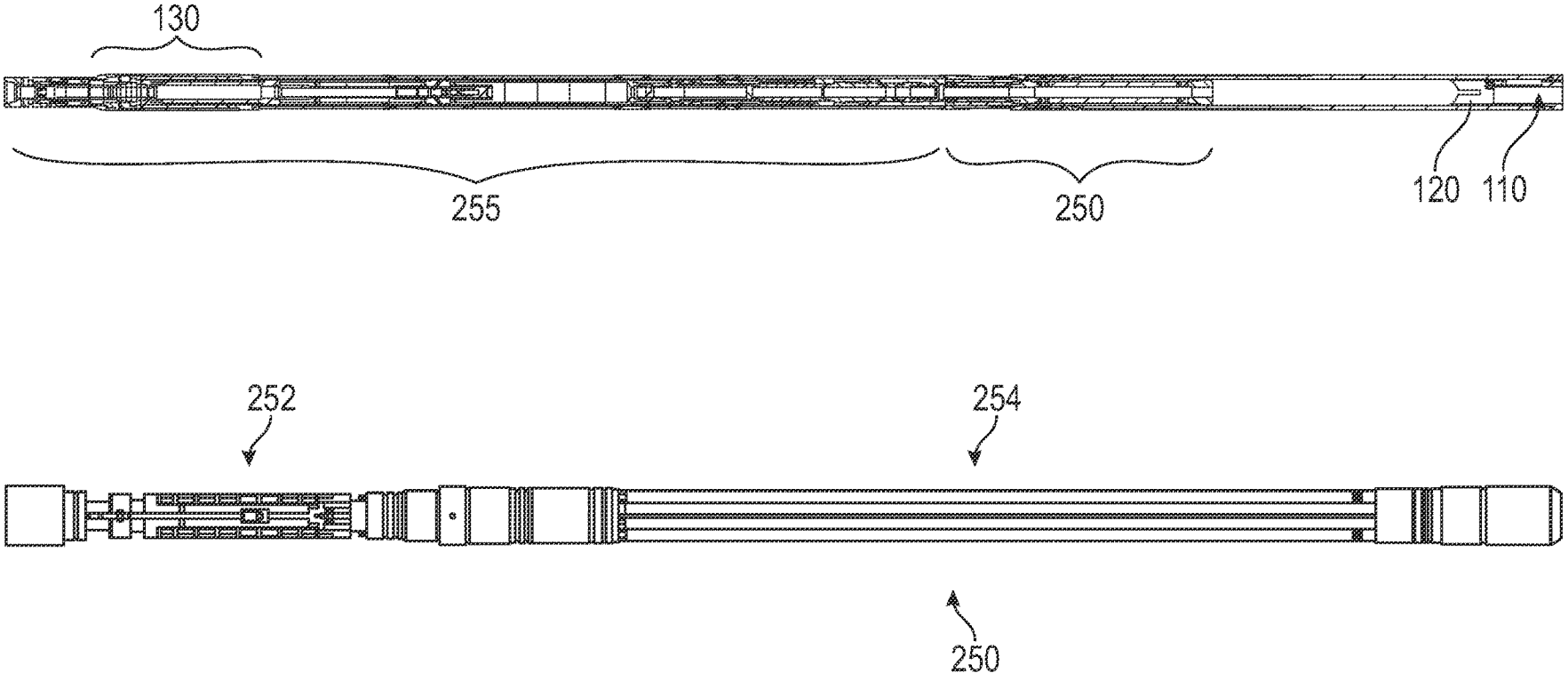
FIG. 9 illustrates an example connector orientation system.

In some configurations, a connector orientation system 250 is integrated into or coupled to a service string 255, for example as shown in FIG. 9. In the illustrated configuration, the connector orientation system 250 includes an electronics module 252 and a telemetry module 254. The electronics module 252 can include accelerometers and/or gyrometers to determine orientation. The electronics module 252 can also include an electronics board. The telemetry module 254 or connector orientation system 250 can include battery packs. Additionally or alternatively, an electrical cable can provide power to the connector orientation system 250 and/or transmit data to/from the connector orientation system 250 and the surface. The telemetry module 254 communicates data, for example, data from the accelerometers indicating orientation of the string, to the surface. In some configurations, the telemetry module 254 communicates to the surface via wireless telemetry, such as Muzic wireless telemetry available from Schlumberger.

For use, the service string 255 and connector orientation system 250 are coupled with the lower completion 100 and run in hole to the desired depth. Data from the accelerometers and/or gyrometers is transmitted to the surface by the telemetry module 254 to determine the orientation of the lower connectors 112. If needed, the service string 255 and lower completion 100 are rotated to orient the connectors 112 to a desired orientation or position, e.g., at or centered about the top of the casing.

As an alternative system and method for connector orientation control, a casing orientation control device and method can be used. For example, FIGS. 10-15 illustrate an example index casing coupling based connector orientation system. As shown, an index casing coupling 350 is included in the casing string. In some applications, there may be limitations on the ability of the lower completion 100 or running assembly 300 or tool 310 to transmit an orientation reading, for example, due to installation depth or overall system cost. An index casing coupling based orientation system can provide an alternative in such situations.

Figure 10:
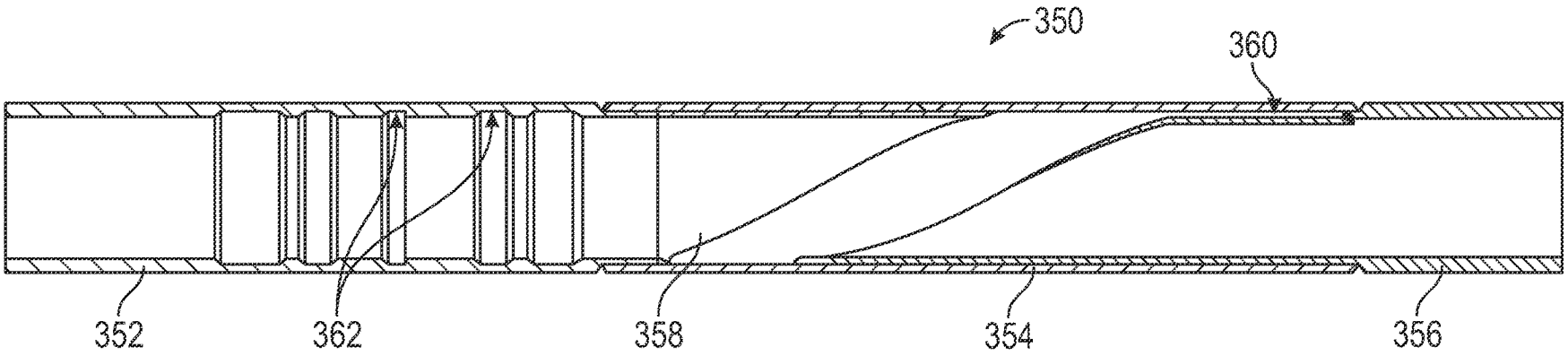
FIG. 10 illustrates a longitudinal cross-section of an example index casing coupling.

As shown in FIG. 10, the index casing coupling 350 includes a coupling 352, a pipe 354, a mule shoe 356, and a backup mule shoe 358. The locating coupling 352 has an internal profile creating one or more landing shoulders 362. The pipe 354 is coupled to a lower end or portion of the locating coupling 352. The mule shoe 356 is coupled to the pipe 354 such that a portion of the mule shoe 356 is disposed below and axially aligned with the pipe 354, and a portion of the mule shoe 356 extends within the pipe 354. An upper end or edge of the mule shoe 356 can have a curved or helical profile. The mule shoe 356 includes an orientation slot 360 extending downward into the mule shoe 356 from the upper edge. The orientation slot 360 can be disposed at a bottom or base of the curved or helical profile. The backup mule shoe 358 is disposed within the pipe 354. The backup mule shoe 358 can be disposed adjacent a lower edge of the coupling 352.

Figure 11A:
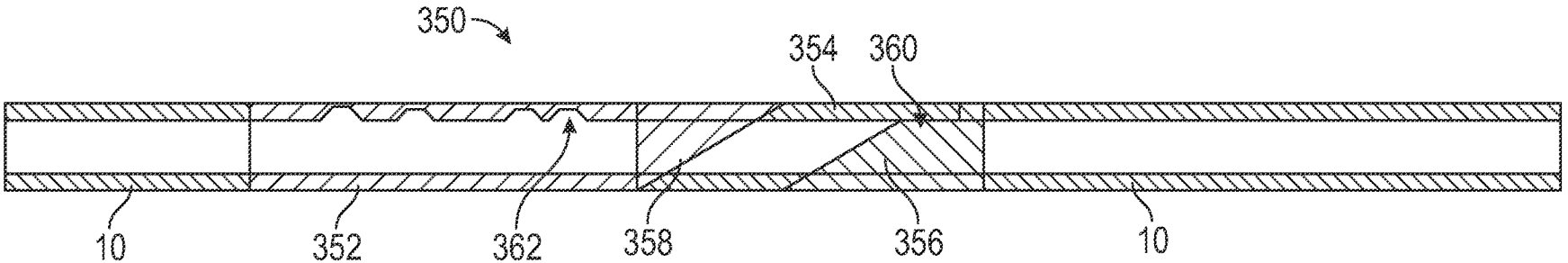
FIG. 11A schematically illustrates the index casing coupling of FIG. 10 integrated into a casing string.
Figure 11B:
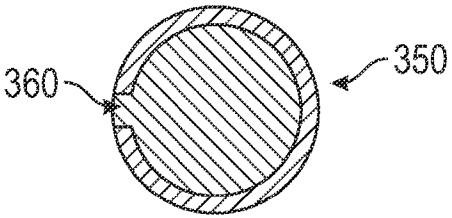
FIG. 11B schematically illustrates a transverse cross-section of the index casing coupling of FIG. 11A.
Figure 12A:
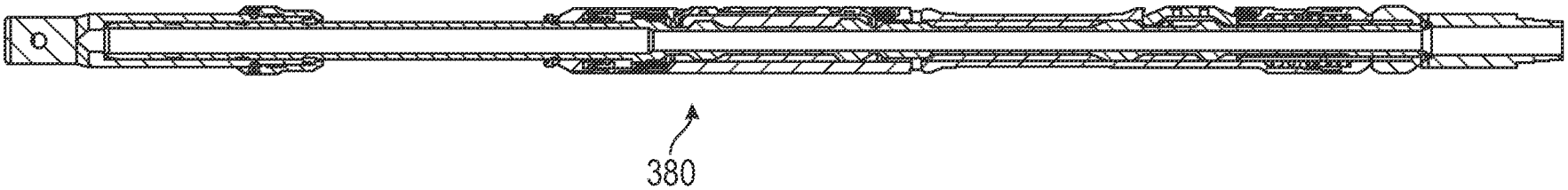
FIG. 12A illustrates a longitudinal cross-section of a service tool.
Figure 12B:
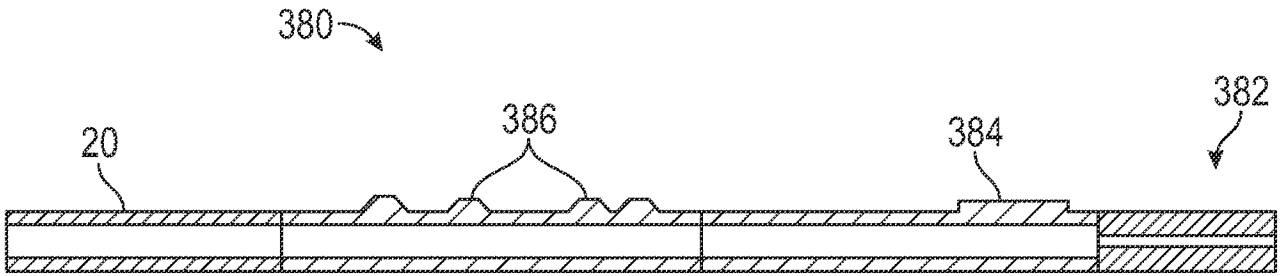
FIG. 12B schematically illustrates the service tool of FIG. 12A.
Figure 13A:
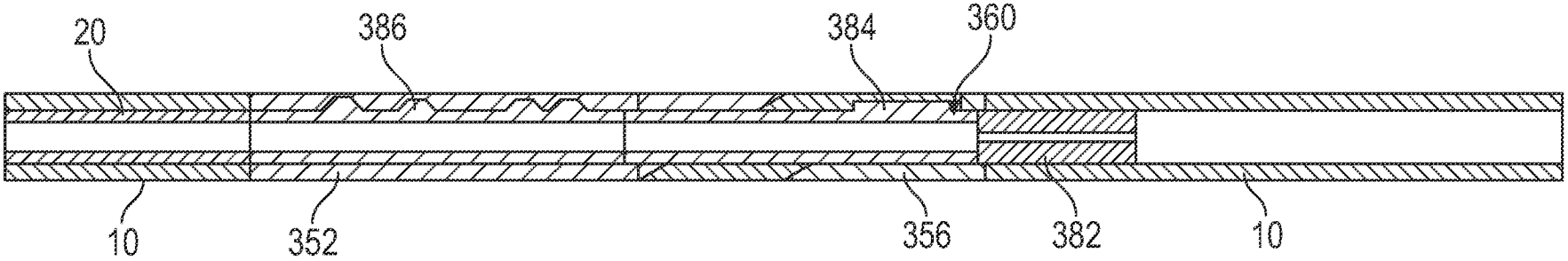
FIG. 13A schematically illustrates the service tool of FIGS. 12A-12B disposed in the casing string of FIG. 11A.
Figure 13B:
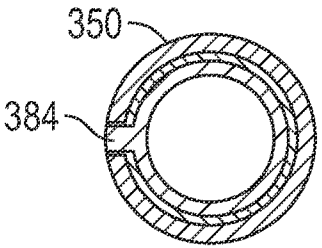
FIG. 13B schematically illustrates a transverse cross-section of the assembly of FIG. 13A.

FIG. 11A schematically shows the index casing coupling 350 incorporated into a casing 10 string. In operation, the casing 10 string, including the index casing coupling 350, is cemented in the well per normal processes. FIG. 11B shows a transverse cross section of the index casing coupling 350 with the orientation slot 360 at an example orientation of 270°. After the casing is cemented, a service tool 380, shown in FIG. 12A, is run in hole to measure the cemented index casing coupling 350 orientation. As shown schematically in FIG. 12B, the service tool 380 includes an orientation measurement tool 382 (for example, an MWD tool), which includes accelerometers or gyrometers, an orientation landing tool including an orientation key 384, and one or more locating dogs 386. The service tool 380 can be coupled to and run on, e.g, tubing 20 or wireline. As the service tool 380 is run in hole, the orientation key 384 can contact the helical profile of the upper edge of the mule shoe 356, and the service tool 380 can rotate until the orientation key 384 is aligned with the orientation slot 360. The service tool 380 is advanced until the orientation key 384 slides into the orientation slot 360, and the locating dogs 386 engage the landing shoulders 362, as shown in FIGS. 13A and 13B.

The measurement tool 382 measures the orientation of the orientation key 384 and therefore the orientation slot 360. For example, the transverse cross-section of FIG. 13B shows an example orientation of 270°. An orientation of 0° or 360° can correspond to a desired orientation, for example, at or centered about a top of the wellbore. The service tool 380 is retrieved, and the orientation landing tool (or an identical orientation landing tool), and optionally the locating dogs 386, are made up with or coupled to the lower completion 100 based on the known index casing coupling 350 orientation, as schematically shown in FIGS. 14A-14B.

Figure 14A:
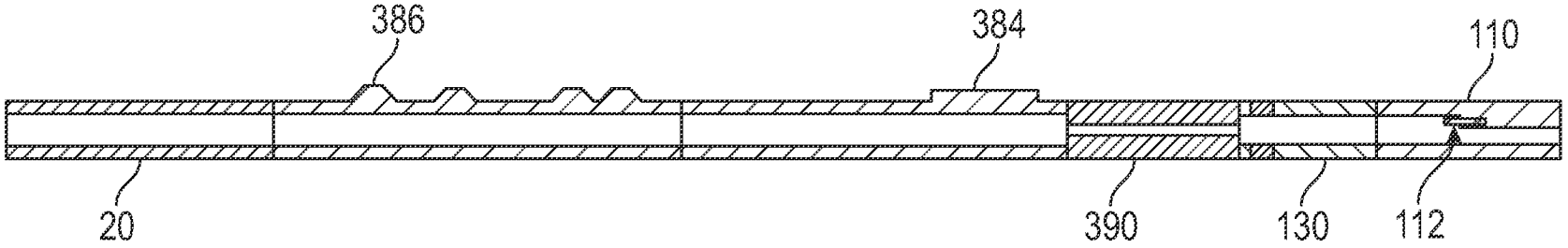
FIG. 14A schematically illustrates a lower completion coupled to a service string including an orientation landing tool.
Figure 14B:
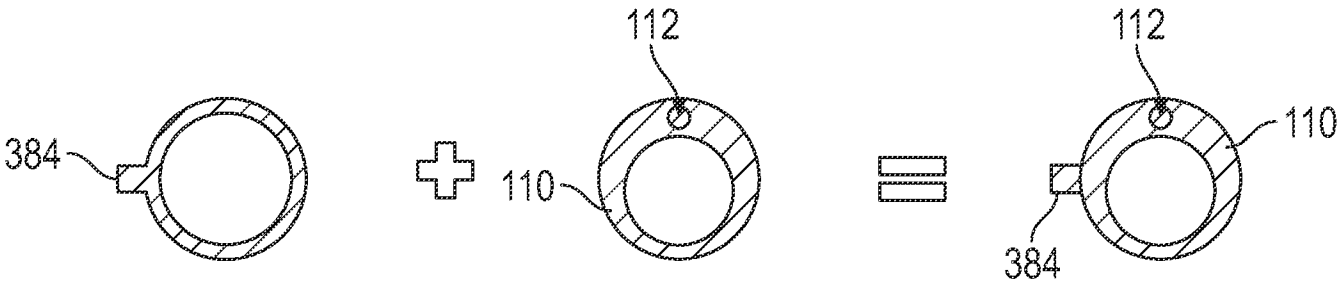
FIG. 14B schematically illustrates transverse cross-sections of the assembly of FIG. 14A.

FIG. 14A schematically shows the lower completion 100 coupled to a service string including the orientation landing tool including the orientation key 384, the locating dogs 386, and an anchoring device 130 such as a packer. The service string can also include a locking expansion joint 390. The orientation landing tool and receptacle 110 are oriented relative to each other such that when the orientation key 384 is oriented at the angular position of the orientation slot 360 as measured by the measurement tool 382, the connector(s) 112 are oriented at the desired orientation of 0° or 360°. In the example orientation of FIG. 14B, the orientation landing tool and receptacle 110 are oriented relative to each other such that the orientation key 384 is disposed at 270° relative to the connector(s) 112, as the orientation slot 360 was measured at 270° as shown in FIG. 13B.

Figure 15A:
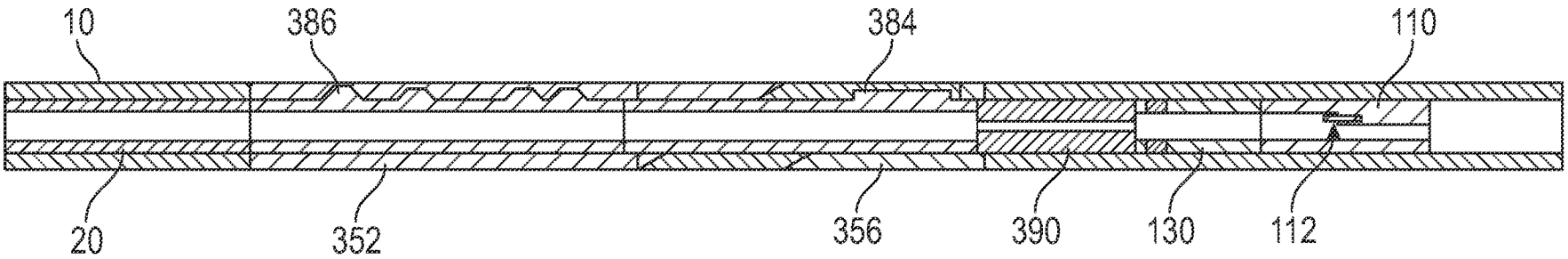
FIG. 15A schematically illustrates a longitudinal cross-section of the assembly of FIG. 14A disposed in the casing string of FIG. 11A.
Figure 15B:
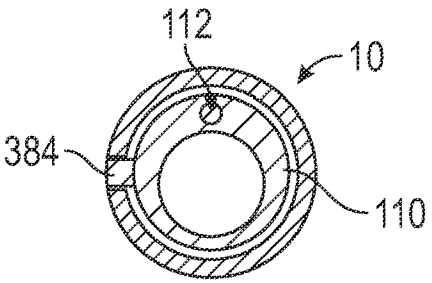
FIG. 15B schematically illustrates a transverse cross-section of the assembly of FIG. 15A.

The orientation landing tool and lower completion 100 are then run in hole within the casing 10 string including the index casing coupling 350, as schematically shown in FIGS. 15A-15B. The orientation key 384 contacts the helical top edge of the mule shoe 356 and rotates until aligned with the orientation slot 360. When the orientation key 384 engages the orientation slot 360, the connector(s) 112 are oriented at the desired orientation of 0° or 360°, for example, at or centered about the top of the wellbore. The lower completion 100 therefore self-rotates such that the connector(s) 112 self-align at the desired orientation.

Figure 16A:
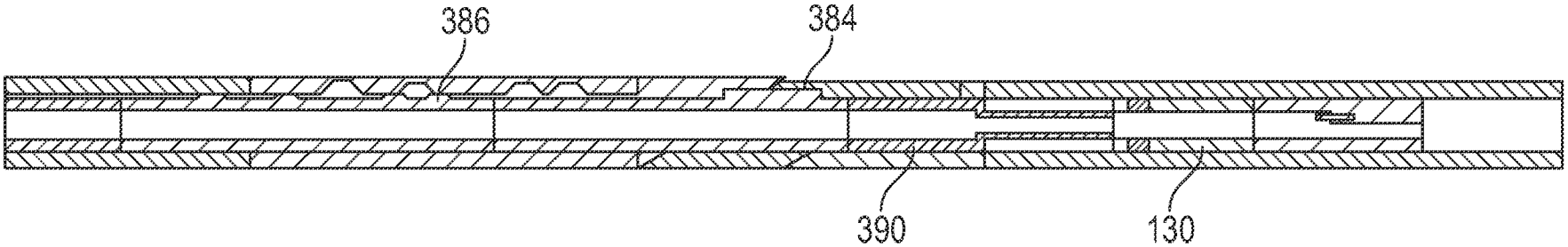
FIG. 16A schematically illustrates a longitudinal cross-section of the assembly of FIG. 15A with a locking expansion joint expanded.
Figure 16B:
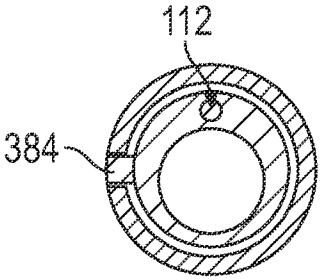
FIG. 16B schematically shows a transverse cross-section of the assembly of FIG. 16A.

Once the lower completion 100 is in place, the anchoring device 130 can be set. To verify the anchoring device 130 is set, the operator can provide overpull and release the locating dogs 386. In configurations including a locking expansion joint 390, the locking expansion joint 390 extends to allow overpull and set down weight to be applied to the anchoring device 130, as schematically shown in FIGS. 16A-16B. The service string, including the locating dogs 386 and expansion joint 390, can then be removed after gravel pack.

Language of degree used herein, such as the terms "approximately," "about," "generally," and "substantially" as used herein represent a value, amount, or characteristic close to the stated value, amount, or characteristic that still performs a desired function or achieves a desired result. For example, the terms "approximately," "about," "generally," and "substantially" may refer to an amount that is within less than 10% of, within less than 5% of, within less than 1% of, within less than 0.1% of, and/or within less than 0.01% of the stated amount. As another example, in certain embodiments, the terms "generally parallel" and "substantially parallel" or "generally perpendicular" and "substantially perpendicular" refer to a value, amount, or characteristic that departs from exactly parallel or perpendicular, respectively, by less than or equal to 15 degrees, 10 degrees, 5 degrees, 3 degrees, 1 degree, or 0.1 degree.

Although a few embodiments of the disclosure have been described in detail above, those of ordinary skill in the art will readily appreciate that many modifications are possible without materially departing from the teachings of this disclosure. Accordingly, such modifications are intended to be included within the scope of this disclosure as defined in the claims. It is also contemplated that various combinations or sub-combinations of the specific features and aspects of the embodiments described may be made and still fall within the scope of the disclosure. It should be understood that various features and aspects of the disclosed embodiments can be combined with, or substituted for, one another in order to form varying modes of the embodiments of the disclosure. Thus, it is intended that the scope of the disclosure herein should not be limited by the particular embodiments described above.

What is claimed is:

1. A downhole completion system, comprising:

an upper completion stage comprising at least one first communication line connector;

a lower completion stage comprising at least one second communication line connector, the at least one first communication line connector configured to couple to the at least one second communication line connector; and an orientation device configured to help determine and/or control orientation of the at least one second communication line connector relative to a well during or prior to installation, wherein the at least one first communication line connector is configured to be de-mated from the at least one second communication line connector based on an orientation of the at least one first communication line connector relative to the at least one second communication line connector.

2. The downhole completion system of claim 1, the lower completion stage comprising two second communication line connectors, the orientation device configured to help center the second communication line connectors about the top of the well.

3. The downhole completion system of claim 1, the orientation device configured to help position the at least one second communication line connector at, near, or about a top of a deviated or horizontal well during installation.

4. The downhole completion system of claim 1, wherein the upper completion stage comprises a stinger and the lower completion stage comprises a receptacle, and wherein the stinger is configured to engage the receptacle.

5. The downhole completion system of claim 4, wherein the stinger comprises the at least one first communication line connector and the receptacle comprises the at least one second communication line connector, and engagement of the stinger with the receptacle engages the at least one first communication line connector with the at least one second communication line connector.

6. The downhole completion system of claim 1, the orientation device comprising accelerometers and/or gyrometers configured to provide data to determine orientation of the second communication line connector.

7. The downhole completion system of claim 6, the orientation device further comprising a telemetry module configured to transmit the data from the accelerometers and/or the gyrometers to the surface to determine the orientation of the at least one second communication line connector.

8. The downhole completion system of claim 1, comprising a service string comprising the orientation device, the service string coupled to the lower completion stage for deployment of the lower completion stage in the well.

9. The downhole completion system of claim 1, the orientation device comprising an index casing coupling incorporated into a casing string deployed in the well, the index casing coupling comprising an orientation feature.

10. The downhole completion system of claim 9, further comprising a service tool comprising an orientation measurement tool and an orientation key, wherein the orientation measurement tool is configured to provide data to determine an orientation of the index casing coupling when the service tool is run in hole in the casing string and the orientation key of the service tool is engaged with the orientation feature of the index casing coupling.

11. A method of forming a completion in a wellbore, the method comprising:

deploying a lower completion stage in a wellbore, the lower completion stage comprising at least one first communication line connector;

determining an orientation of the at least one first communication line connector with respect to the wellbore;

deploying an upper completion stage in the wellbore, the upper completion stage comprising at least one second communication line connector; and coupling the at least one first communication line connector and the at least one second communication line connector, wherein the at least one first communication line connector is configured to be de-mated from the at least one second communication line connector based on an orientation of the at least one first communication line connector relative to the at least one second communication line connector.

12. The method of claim 11, wherein determining the orientation of the at least one first communication line connector comprises transmitting data from an orientation device located on or connected to the lower completion to the surface via an electrical cable or wireless telemetry.

13. The method of claim 11, wherein the wellbore is a deviated or horizontal wellbore.

14. The method of claim 11, further comprising rotating the lower completion if needed to orient the at least one first communication line connector in a desired orientation or position.

15. The method of claim 14, wherein the wellbore is a deviated or horizontal wellbore and the desired orientation or position is at, near, or centered on or about a top of the wellbore.

16. A method of forming a completion in a wellbore, the method comprising:

incorporating a casing orientation device into a casing string;

deploying the casing string in the wellbore;

running a service tool in hole within the casing string;

measuring an orientation of the casing orientation device using an orientation measurement tool of the service tool;

deploying a lower completion stage in the wellbore such that one or more first communication line connectors of the lower completion stage are positioned in a desired orientation based on the orientation of the casing orientation device measured by the service tool;

deploying an upper completion stage in the wellbore, the upper completion stage comprising at least one second communication line connector; and coupling the first and second communication line connectors.

17. The method of claim 16, wherein the casing orientation device comprises an orientation feature, the service tool comprises a corresponding orientation feature, and running the service tool in hole comprises engaging the orientation feature of the service tool with the orientation feature of the casing orientation device.

18. The method of claim 17, wherein measuring the orientation of the casing orientation device comprises determining an orientation of the orientation feature relative to the desired orientation of the one or more first communication line connectors when deployed in the wellbore.

19. The method of claim 18, further comprising, prior to deploying the lower completion stage in the wellbore, coupling an orientation landing tool comprising an orientation feature to the lower completion stage, and orienting the orientation landing tool and the lower completion stage relative to each other such that when the orientation feature of the orientation landing tool is positioned at the orientation of the orientation feature of the casing orientation device as measured by the service tool, the one or more first communication line connectors are positioned at the desired orientation.

20. The method of claim 16, wherein the wellbore is a deviated or horizontal wellbore and the desired orientation or position is at, near, or centered on or about a top of the wellbore.

* * * * *